United States Patent [19]

Hayashi et al.

[11] 4,439,318

[45] Mar. 27, 1984

[54] SYSTEM FOR TREATING RADIOACTIVE WASTE

[75] Inventors: Masaru Hayashi, Tokyo; Atsushi Tagusagawa, Kobe; Fumiaki Komatsu; Yoshihisa Sawada, both of Nishinomiya; Yorihisa Sakaki, Akashi, all of Japan

[73] Assignee: Kobe Steel, Ltd., Kobe, Japan

[21] Appl. No.: 221,355

[22] Filed: Dec. 29, 1980

[30] Foreign Application Priority Data

Dec. 28, 1979 [JP] Japan ..... 54-184308[U]
May 6, 1980 [JP] Japan ..... 55-060291

[51] Int. Cl.[3] ..... G21F 9/20; G21F 9/06; G21F 9/10

[52] U.S. Cl. ..... 210/208; 252/632; 422/159; 422/903

[58] Field of Search ..... 422/903, 159; 252/632; 210/208

[56] References Cited

U.S. PATENT DOCUMENTS 4,221,680 9/1980 Hardwick et al. ..... 422/159 X

FOREIGN PATENT DOCUMENTS 53-17572 2/1978 Japan .
1510494 5/1978 United Kingdom .

*Primary Examiner*—Herbert B. Guynn
*Attorney, Agent, or Firm*—Oblon, Fisher, Spivak, McClelland & Maier

[57] ABSTRACT

A system for treating radioactive waste employing a rotary mechanism which contains in its rotational path of travel a number of stages for the treatment, i.e., a stage of condensing a slurry of radioactive waste, a stage for drying the condensed waste and a stage for storing dried waste temporarily for feeding to a melting furnace. The rotary mechanism employs a number of containers for transferring the radioactive waste to and from the respective stages along the rotational path of travel.

6 Claims, 10 Drawing Figures

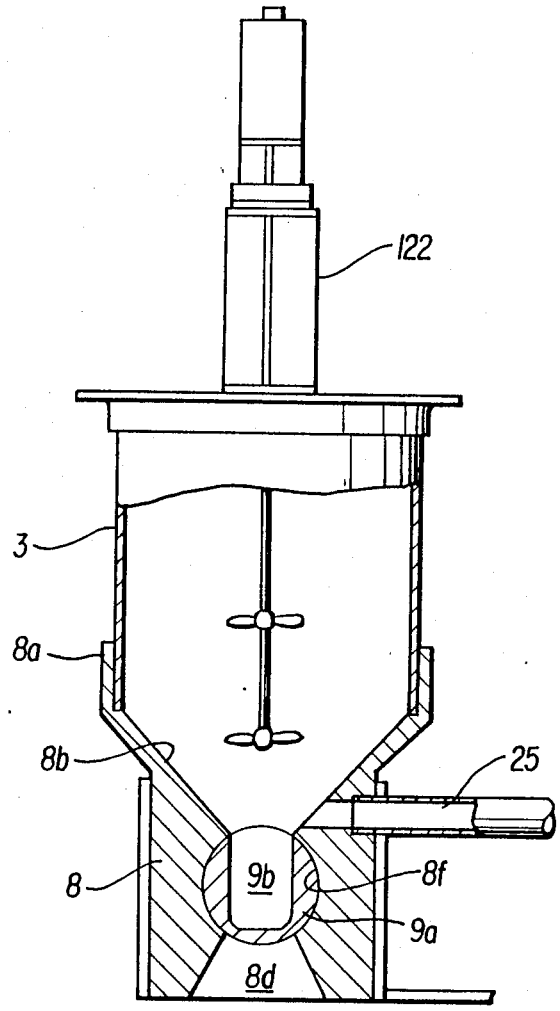
FIG. 3
FIG. 4
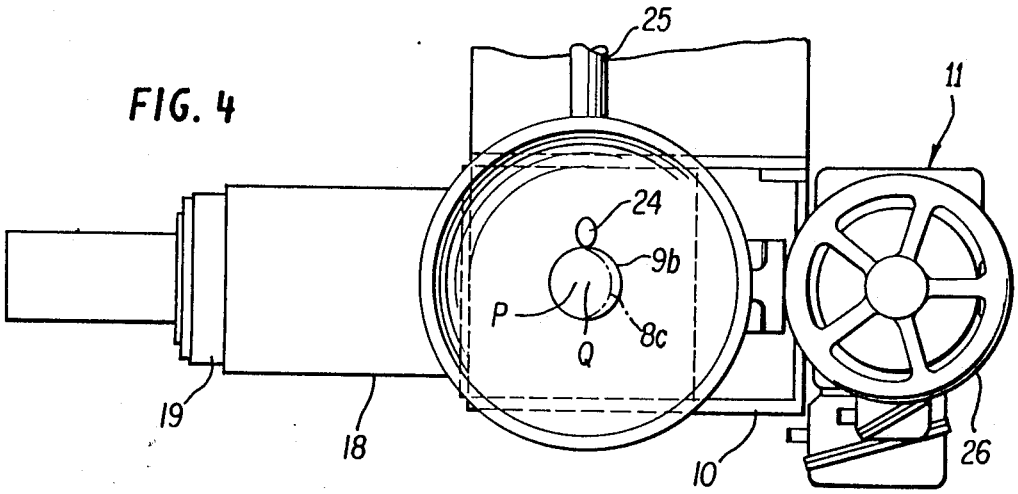

SYSTEM FOR TREATING RADIOACTIVE WASTE

BACKGROUND OF THE INVENTION

1. Field of the Invention

This invention relates to a comprehensive system for treating radioactive waste, including the stages of condensation of radioactive waste in the form of slurry which is discharged in a large quantity from an atomic plant, drying the condensate, and melting and solidifying the dried material, and more particularly to a comprehensive system for treating radioactive waste including up to a stage of feeding dried waste to a hopper of a melter.

2. Description of the Prior Art

There have already been proposed a number of methods for treating radioactive waste of slurry form containing radioactive components like primary cooling water of an atomic pile including Japanese Laid-open Patent Specification No. 17572/78, in which it has been considered to be advantageous from the stand point of economical disposal of the radioactive waste to store the same after sedimental collection, drying, melting and solidification of the radioactive component.

However, at the present stage of the art, no apparatus has been developed which can effectively put into practice the above-mentioned methods.

SUMMARY OF THE INVENTION

Under these circumstances, the present invention has as its object the provision of a comprehensive system which can treat a slurry with radioactive components efficiently in one place by successively condensing and drying the radioactive waste into a form ready for charging to a hopper of a melter.

According to the present invention, there is provided a system for treating radioactive waste including, a storage tank for holding a slurry of the radioactive waste; a condensing tank for condensing the slurry of the radioactive waste received from the storage tank, a dryer for drying the condensed radioactive waste, a hopper for receiving the dried radioactive waste, and a rotary mechanism for transferring the radioactive waste to and from the condensing tank, dryer and hopper, the rotary mechanism having a number of containers for holding the radioactive waste, rotary arms for supporting the containers, a rotational drive mechanism for the rotary arms, and a lift mechanism for vertically lifting the rotary arms up and down.

The above and other objects, features, and advantages of the invention will become apparent from the following description and the appended claims, taken in conjunction with the accompanying drawings which show by way of example a preferred embodiment of the present invention.

BRIEF DESCRIPTION OF THE DRAWINGS

In the accompanying drawings:

FIG. 3 is a sectional view across a rotary collector shaft;

FIG. 4 is a plan view of the rotary collector;

DETAILED DESCRIPTION OF THE PREFERRED EMBODIMENTS

Figure 1:
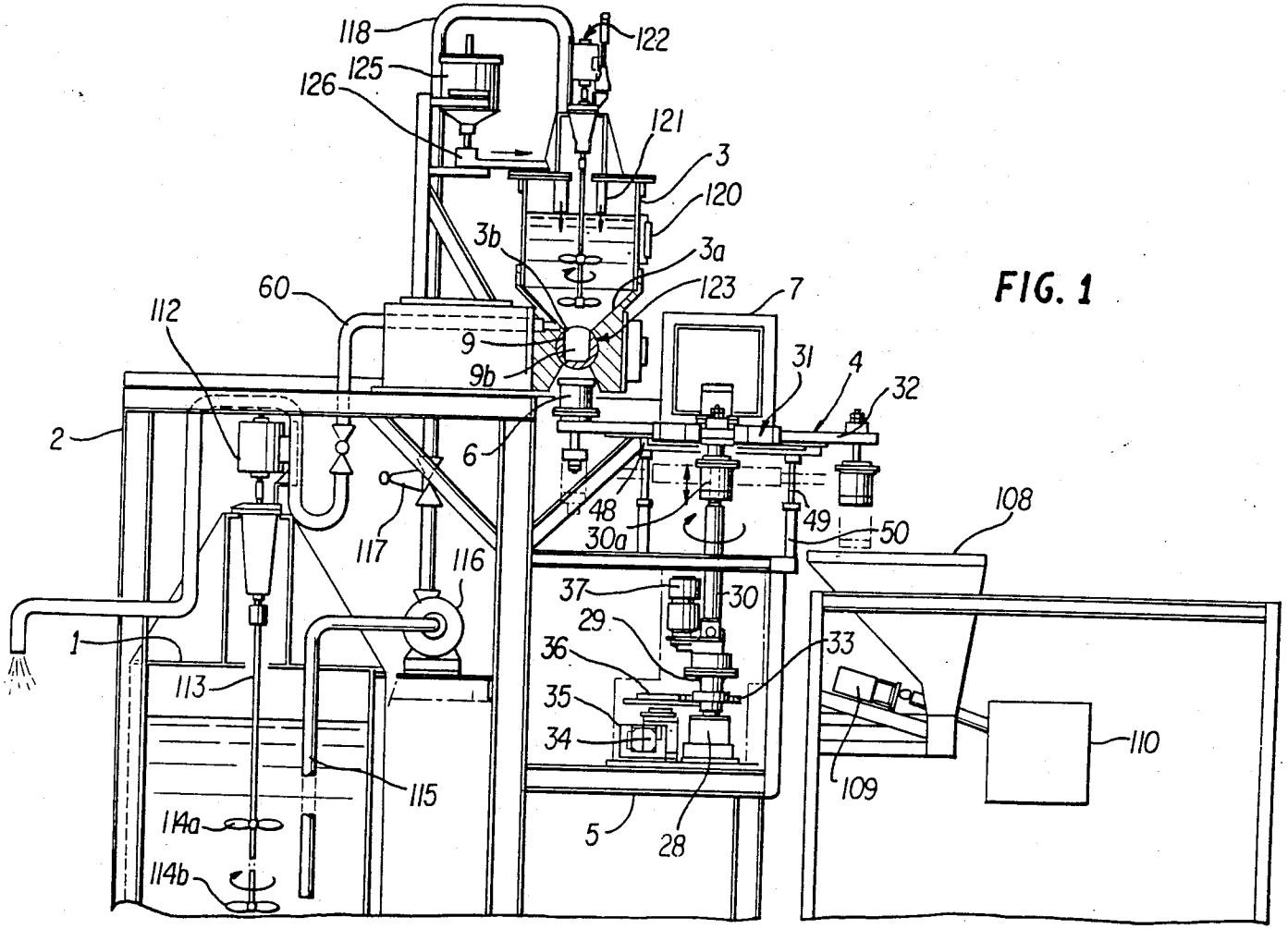
FIG. 1 is a schematic illustration of a system for treating radioactive waste according to the present invention.

Referring to the accompanying drawings and first to FIG. 1, indicated at reference number 1 is a tank which is provided in the lower half of a fixed frame 2 to hold a slurry of radioactive waste therein, and at 3 a vessel which is supported on top of the frame 2 for condensing the slurry and which is in the particular example shown, a sedimentation tank. Provided beside the frame 2 is a side frame 5 of a smaller height supporting thereon a rotary mechanism which turns a number of pots 6 along a predetermined rotational path of travel. Designated at reference number 7 is a drying such as a microwave dryer for drying the condensate which is accommodated in the pot 6, and at 108 is a hopper which receives the dried material and supplies the same to a melter 110 of the next stage, if necessary, by means of a feeder 109.

In the upper portion of the slurry storage tank 1 is provided a stirrer 112 with upper and lower stirring blades **114*a* and 114*b* which are mounted on a drive shaft 113. The slurry in the tank 1 is sucked by a slurry feed pump 116 through a suction pipe 115 and quantitatively fed to the sedimentation tank 3 through a pipe 118 with an electromagnetic valve 117**.

The sedimentation tank 3 is provided with a level switch 120 which produces a signal when the slurry fed from the slurry feed pump 116 reaches a predetermined level, thereby stopping operation of the pump 116 and closing the electromagnetic valve 117 to suspend the supply of the slurry to the tank 3. The sedimentation tank 3 is supplied with a high molecular weight flocking liquid through a nozzle 121, which is mixed with the slurry by a stirrer 122 which is mounted on top of the tank 3. The slurry contains in addition iron rust such as hematite and magnetite radioactive corrosion products of cobalt, manganese and the like. The suspended radioactive components are flocked by the high molecular weight flocking liquid and gradually fall on the bottom **3*a* of a inverted conical shape and finally in to a rotary collector 123 which is located at the converging end of the bottom portion 3*a***.

Indicated at reference number 125 is a hopper which holds a fusible additive which is to be used in the succeeding melting and solidifying stage, the fusible additive in the hopper 125 being supplied to the sedimentation tank 3 in a predetermined quantity through a feeder 126. The fusible additives are dispersed into the slurry by the stirrer 122 and collected in the rotary collector 123 in the form of a mixture with the radioactive substances.

The above-mentioned rotary collector 123 includes a cylindrical rotary shaft 9 which is provided with a cavity **9*b* in alignment with the opening 3*b* at the bottom end of the sedimental tank 3 to receive the condensate in the cavity 9*b*. The condensate received in the cavity 9*b*** is dropped into a pot 6 as the cavity 9b is turned 180° about the axis of the shaft 9.

Figure 2:
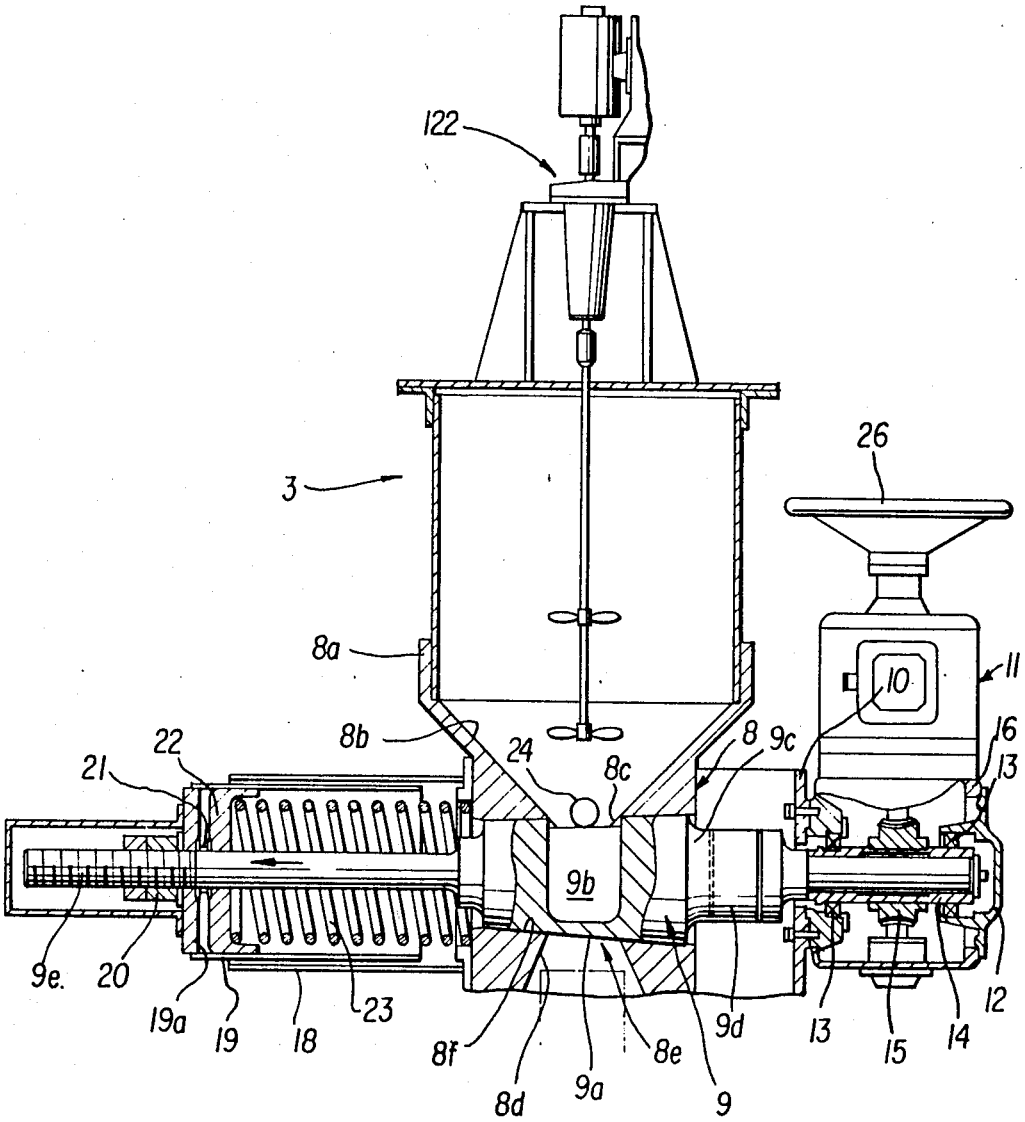
FIG. 2 is a schematic vertical section of a rotary collector.

FIG. 2 shows a more specific example of the rotary collector 123, in which the collector 123 includes a metal housing of stainless steel having an annular portion 8a fixedly fitted on the outer periphery of the sedimentation tank 3 and, contiguously to the annular portion 8a, a collecting portion of inverted conical shape forming the bottom of the sedimentation tank 3. The housing 8 is provided with an opening 8d at the converged bottom end of the collecting portion 8b in communication with a conical opening 8d in the bottom wall of the housing 8 through a vertical bore 8e formed in alignment with the vertical center line of the sedimentation tank 3.

A rotary shaft 9 is journalled in a horizontal bore 8f which is formed in the housing 8 of stainless steel or other metal across the vertical bore 8e, the rotary rod 9 having in the intermediate portion thereof a tapered body 9a which is fitted in a liquid-tight manner in the horizontal bore 8f to prevent leakage of the slurry. The tapered body portion 9a is centrally provided with a cup-shaped cavity 9b at a position substantially in vertical alignment with the opening 8c in the bottom wall of the housing 8 to receive and collect flocks which gravitate through the opening 8c.

One end 9c of the rotary shaft 9 is extended axially through a cup ring 9d and keyed to a rotational sleeve 14 which is rotatably journalled in bearings 13 within a housing 12 of a rotational drive mechanism 11 fixed on a support frame 10. The rotational sleeve 14 has a worm wheel 15 fixedly fitted thereon and rotatingly driven by a worm shaft 16 which is connected to a motor 10, thereby rotating driving the collector shaft 9.

The other end of the collector shaft 9 is extended through a cylindrical spring cover 19 which is rotatably and axially slidably fitted in a cylindrical tool 18 fixed on one side wall of the housing 8. An externally threaded end 9e of the shaft is engaged in an internally threaded screw member 20 which is supported on an end wall 19a of the cover 19. A compression coil spring 23 having a large spring constant is interposed between the side wall of the housing 8 and a spring seat 22 which is coaxially and rotatably supported on the end wall 19a through a bearing 21 relative to the shaft 9, constantly urging the shaft 9 in the direction indicated by the arrow to maintain the intimate fitting contact between the tapered body 9a of the shaft 9 and the bore 8f. In this instance, it is desirable to have a fitting surface pressure of 1 kg/cm$^2$ or greater from the standpoint of secure sealing.

The cavity 9b in the tapered body 9a of the rotary shaft 9 is shaped in an oval form in section as shown in FIG. 4, with the longer axis of the oval being disposed in the axial direction of the rotary shaft 9 to provide a large allowance to its axial alignment with the opening 8c at the bottom of the housing 8. In an initially assembled state, the center Q of the cavity 9b is preferred to be located slighly closer to the diverged end of the bore 8f in consideration of the friction which would result from the rotation of the rotary shaft 9.

In FIGS. 2 to 4, reference number 24 denotes a passage which opens into the bottom portion 8b of inverted conical shape of the housing 8 and is connected to a discharged pipe 25 as shown in FIG. 3 to discharge a supernatant liquid from the tank 3. Designated at reference number 26 in FIGS. 2 and 4 is a handle for manual operation of the rotary shaft 9.

In operation, the sedimentation tank 3 receives a slurry to be treated, for example, a slurry containing radioactive suspended matter (hereinafter referred to as "clud slurry") which is filtered out from primary cooling water of a pile or the like. The major components of the clud slurry are iron oxides which are suspended in a concentration of 500–50,000 ppm.

When feeding the clud slurry to the sedimentation tank 3, the rotary collector shaft 9 is retained in the collecting position shown in FIGS. 2 and 3. After feeding a predetermined quantity of the clud slurry to the tank 3, the stirrer 122 is started to mix the clud slurry. For this purpose, the stirrer is preferably driven at a speed of 100–200 r.p.m. Next, a predetermined amount of flocking agent of high molecular weight is added to the slurry in a concentration of about 2–10 ppm to flock the suspended substances.

After continuing the stirring at that speed for a predetermined time period, the stirring speed is reduced to allow small flocks to grow into larger ones so as to facilitate the sedimentation of the flocks. Upon lapse of a predetermined time, the stirrer is stopped and the suspension is left to stand for a predetermined time for sedimentation of the flocks. The precipitated flocks flow down the tank 3, guided by the bottom wall 8b of inverted conical shape, and finally settle in the cavity 9b in the tapered body portion 9a of the rotary collector shaft 9.

After sedimentation for a predetermined time period, the supernatant liquid is drawn out and collected by opening a valve (not shown) of the discharge pipe 25. Thereafter, the motor of the rotational drive mechanism 11 is actuated to rotate the rotary collecting shaft 9 through 180° via worm shaft 16 and worm wheel 15, turning the cavity 9b upside down to drop the sediment into a pot 6 of the rotary transfer mechanism 4 which is located beneath the collector shaft 9.

Figure 5:
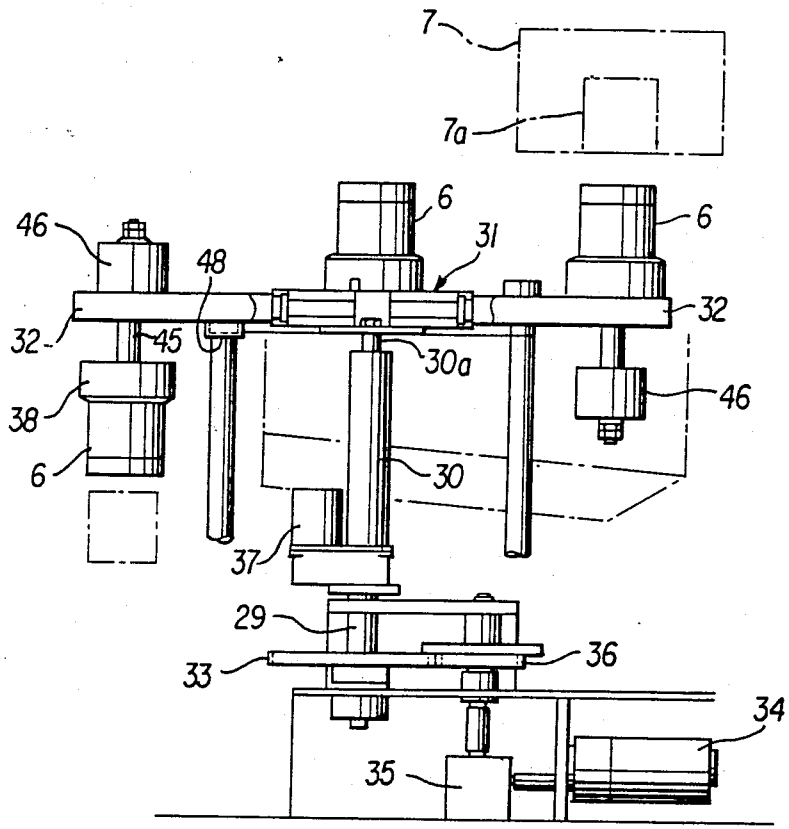
FIG. 5 is a schematic view of a rotary transfer mechanism.

As shown in FIG. 5, the rotary transfer mechanism 4 basically includes a center shaft 29 which is rotatably supported on the side frame 5 by a bearing 28 for rotation about a vertical axis, a hydraulic cylinder 30 which is coaxially fixed to the upper portion of the center shaft 29, and a rotary head 31 which is attached to the upper end of a plunger 30a of the hydraulic cylinder 30. The rotary head 31 supports thereon four rotary arms 32 which have the respective base ends thereof supported in bearings for rotation about a horizontal axis, each rotary arm 32 supporting reversibly at its outer or fore end a pot 6 for receiving the collected sediment.

A driven gear 33 which is fixedly mounted at an intermediate position on the center shaft 29 is meshed with a drive gear 36 which is driven from a motor 34 through a reducer 35, so that the center shaft 29 is rotated upon actuating the motor 34. If necessary, the hydraulic cylinder 30 is operated by a hydraulic control device 37 to lift or lower the rotary head 31 through the plunger 30a.

Instead of such a mechanism as hydraulic cylinder 30, a lifting and lowering mechanism such as a power cylinder may be installed beneath the dryer 7 and the rotary collector 123, respectively in which the pot 6 is lifted and lowered by means of such lifting and lowering mechanism installed beneath the dryer or the rotary collector when, through the rotation, the pot 6 reaches the position where the pot 6 receives the collected sediment and where the collected sediment in the pot 6 is subjected to the drying tratment in the dryer 7.

Figure 7:
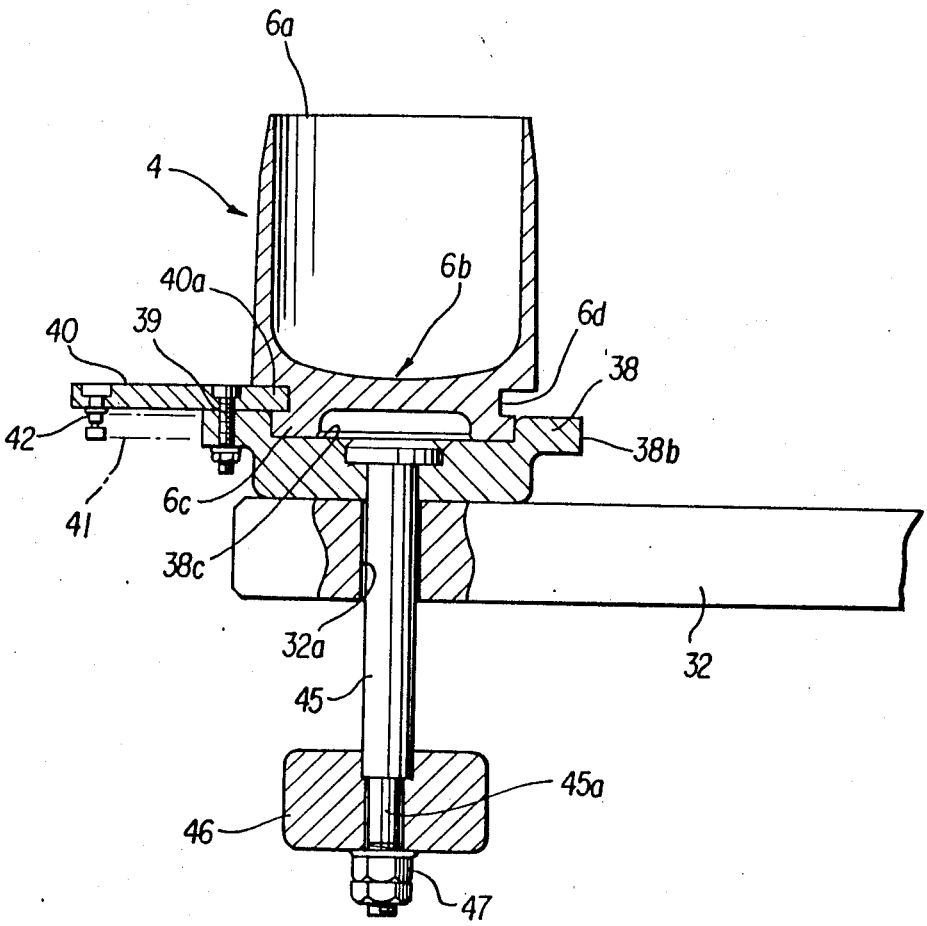
FIG. 7 is a schematic section of a pot supporting structures.
Figure 8:
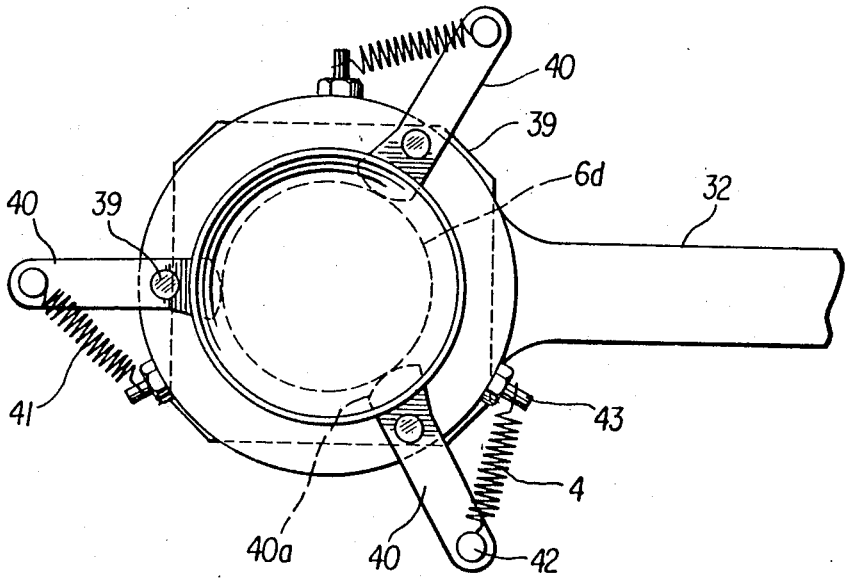
FIG. 8 is a plan view of the pot supporting structures.

As shown in FIG. 7 each pot 6 is in a tapered form with an inside diameter increasing toward the upper open end and a round bottom so that is contents are easily released when the pot 6 is turned upside down. Contiguously beneath an annular groove 6*d*, the pot 6 is provided with a flanged bottom wall 6*c* to be fitted in a recess 38*a* of a seat plate 38 which is mounted on the rotary arm 32. The seat plate 38 is provided with a flanged portion 38*b* around its outer periphery, on which a locking lever 40 is hinged by a hinge pin 39 rockably in a horizontal plane. As shown in FIG. 8, a pawl portion 40*a* at the fore end of the locking lever 40 is fitted into the annular groove 6*d* on the outer periphery of the pot 6. In this manner, the pot 6 and seat plate 38 are integrally connected with each other by hinge pins which are located at three positions on the outer periphery of the pot 6. In FIGS. 7 and 8, indicated at reference number 41 is a spring tensioned between a spring stop pin 42 fixed at the rear end of the locking lever 40 and a spring stop pin 43 fixed on the circumference of the seat plate 38, urging the locking lever in the locking direction.

Fixedly secured to the center portion of the seat plate 38 of the pot 6 is the upper end of a reversing rod 45 which is extended vertically through a bore 32*a* in the fore end portion of the rotary arm 32 and provided with an externally threaded portion 45*a* at its lower end in engagement with a weight 46 and a stop nut 47. The pot 6 is thus stably supported on the rotary arm 32 by the weight 46 and, when the pot is turned upside down, the contents of the pot are assuredly released by the falling impact of the weight 46.

Figure 6:
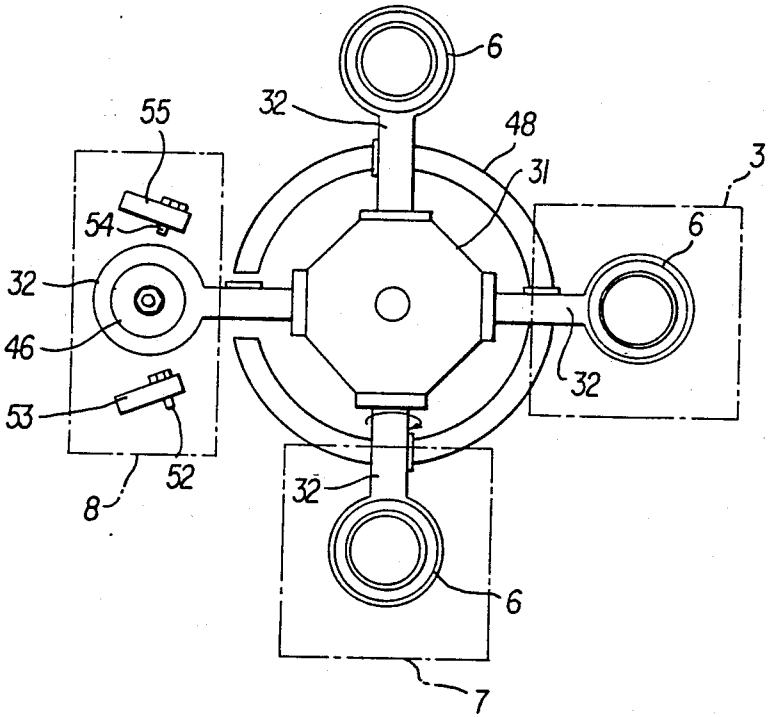
FIG. 6 is a plan view of the rotary transfer mechanism.

In FIGS. 1, 5 and 6, designated at reference number 48 is a circular guide rail which guides the turning movements of the rotary arms 32 on the underside thereof and which is liftable up and down and normally urged upward by guide rods 49 and guide cylinders 50.

As shown in FIG. 1, the sedimentation tank 3 and drier 7 are located above the locus of rotation of the pots 6 on the rotary arms 32 and in postions spaced from each other by 90° about the axis of rotation as particularly shown in FIG. 6. In this instance, the lower opening of the rotary collector shaft 9 at the bottom of the sedimentation tank 3 is positioned such that it is brought into alignment with the center axis of a pot 6 into which the latter is turned to a receiving position, ensuring that the dropped sediment is received in the pot 6.

On the other hand, the hopper 108 is located beneath the locus of rotation of the pots 6 at a position 90° shifted from the drier 7 so that the dried material in the pot 6 is dropped into the hopper 108 when the pot 6 is turned upside down as will be descirbed hereinafter.

As shown in FIG. 6, in order to invert the pots 6, a pot-inverting mechanism is provided above the hopper 108, including a knock pin 52 which is supported on an arm 53, knocking upside down the pots 6 which are successively turned toward the hopper 8. The inverted pot 6 is turned up again by an upturning knock pin 54 similar to the pot-upsetting knock pin 52, which is supported on an arm 55 at a position rotationally forward of the hopper 108.

Figure 9:
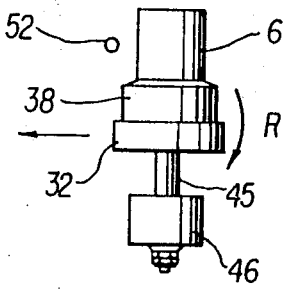
FIG. 9 is a view explanatory of the inversion of a pot.
Figure 10:
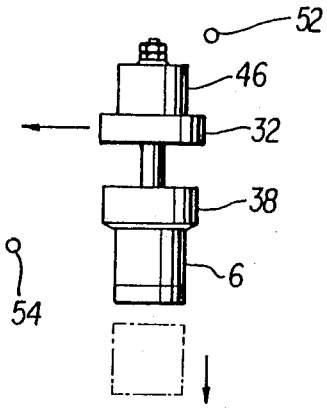
FIG. 10 is a view showing an inverted pot to be upturned into initial upright position.

Referring to FIG. 9, the pot-upsetting pin 52 strikes the outer wall surface of the pot 6 when the latter is rotated by the rotary arm 32 to a point above the hopper 108, and upon further rotation the pot 6 is turned upside down along with the rotary arm 32 about the axis thereof as indicated by an arrow R in FIG. 10. Upon inversion of the pot 6, the weight 46 is allowed to drop freely by play of the rod 45 relative to the rotary arm 32 and strikes the latter, impacting on the pot 6 to encourage dumping of its content.

The inverted pot 6 is then hits an upturning pin 54 which is, as shown in FIG. 10, located in a position beneath and spaced by a certain angle from the inverting pin 52, causing the vacant pot 6 and arm 32 to turn clockwise to assume again the upright position.

In operation of the above-described treating system, with stirring by the stirrer 112, a slurry in the slurry tank 1 is fed to the sedimentation tank 3 through conduits 115 and 118 by operation of the slurry feed pump 116. As soon as the slurry in the sedimentation tank 3 reaches a predetermined level, the level switch 120 is actuated to stop the slurry feed pump 116 to suspend the feed of the slurry. A predetermined amount of a high molecular weight flocking liquid is added to the slurry in the sedimentation tank 3 through the nozzle 121 and mixed therewith by actuating the stirrer 122. Simultaneously, a fusible additive stored in the hopper 125 which is quantitatively fed by the feeder 126 is also mixed into the slurry in the tank 3.

In this stirring and mixing stage, the radioactive substances in the slurry is flocked by the high molecular weight flocking liquid and upon stopping the stirrer 122 allowed to fall by gravitation onto the bottom portion 3*a* of the tank, finally settling in the cavity 9*b* of the rotary collector 123. In this flocking and settling stage, the fusible additive is also collected together with the condensate in the form of a mixture with the radioactive substances.

At the time point when the sedimentation has proceeded in a sufficient degree, the supernatant liquid is drawn out of the tank 3 by opening the electromagnetic valve in the discharge pipe 60 which communicates with the bottom portion 3*a* of the tank 3, sending the liquid to a waste water treating process.

After the extraction of the supernatant liquid, the rotary shaft 9 of the rotary collector 123 is rotated by 180° to drop the condensate in the cavity 9*b* into a pot 6 which has been lifted to a position close to the outlet opening 8*e* of the rotary collector 123 by the operation of the lift cylinder 30.

During the above-described flocking and collecting operation, a condensate collected by the preceding flocking and collecting operation is dried in the dryer 7 until the succeeding mass of condensate is received in a vacant pot 6, whereupon the cylinder 30 is once again lowered and the motor 34 is actuated to rotate the rotary arm 32 through 90° to bring the received condensate to a position beneath the dryer 7. The water vapor which is generated by heating is passed through an exhaust gas treating device like a condenser.

As a result of the rotation of the arms 32, the pot 6 which holds the dried condensate is turned upside down above the hopper 8 by the pin 52 of the pot-inverting mechanism of FIG. 6 to release the dried condensate into the hopper 8 in the manner as explained hereinbefore in connection with FIG. 9. At this time, the dried material which is deposited on the inner wall surface of the pot 6 is caused to fall off more forcibly by the impact of the dropping weight 46 than in a case resorting to natural or spontaneous falling of the material.

After the 90° rotation, the rotary head 31 is lifted by the operation of the lift cylinder 30 to position a vacant pot 6 immediately beneath the rotary collector 123 of the sedimentation tank 3 while passing a pot 6 filled with a condensate to the dryer 7 from beneath for heating and drying the condensate.

During the above-described revolution of the rotary head 31, a pot 6 which passes over the hopper 108 in an inverted state is turned upward into an upright position and is stopped at a stand-by position.

The dried condensate released into the hopper 8, which is a mixture of the radioactive substances and fusible additive, is fed into the melting furnace 110 by the feeder 109. The mixture which is melted in the furnace 110 is solidified and put in a storage container, which is then capped, sealed and cleaned of contaminants for storage over a long time period. The condensate in the pots which is heated and dried by a single dryer in the foregoing embodiment may be adapted to be preheated and then fully heated by dryers which are located in two separate positions in the rotational path of travel. Further, although the fusible additive is admixed to the slurry in the sedimentation tank, it may be fed to and mixed with the condensate in the hopper 108 prior to charging to the melting furnace 110.

As clear from the foregoing description, the present invention employs a rotary mechanism which includes in its rotational path of travel a number of stages required for treating a slurry for radioactive substances, i.e., a stage of condensation for the slurry, a stage of heating and drying the condensate and a stage for transfer to a melting furnace, prior to the final melting and solidifying stages, thereby allowing treating of radioactive waste continuously in one place.

According to the invention, the waste is subjected continuously and successively to the respective stages of treatment by the operation of a single rotary mechanism so that it becomes possible to enhance the capacity of treatment and to reduce the floor space required for the treating operation. In addition, the rotary mechanism with liftable pots simplifies the treating operation and permits remote control or complete automation of the treating operation.

Obviously, numerous modifications and variations of the present invention are possible in light of the above teachings. It is therefore to be understood that within the scope of the appended claims, the invention may be practiced otherwise than as specifically described herein.

What is claimed is:

1. A system for treating radioactive waste, comprising:

a storage tank holding a slurry of the radioactive waste;

a condensing tank for condensing the slurry of radioactive waste received from said storage tank;

a dryer for drying the condensed radioactive waste;

a hopper for receiving the dried radioactive waste;

a rotary mechanism for transferring the radioactive waste from said condensing tank and to said dryer and hopper, said rotary mechanism comprising a plurality of containers for holding the radioactive waste, rotary arms for supporting said containers, a rotational drive mechanism for rotating said rotary arms, means for discharging the radioactive waste from said containers to said hopper, and a lift mechanism for vertically lifting said containers up and down; and a rotary collector positioned in a lower portion of said condensing tank for receiving the condensed radioactive waste and selectively transferring it to said containers.

2. A system as set forth in claim 1, wherein said condensing tank and dryer are located successively above the rotational path of travel of said containers and said hopper is located beneath said rotational path of travel in a position spaced from said dryer by a predetermined angle about the axis of rotation of said rotary mechanism.

3. A system as set forth in claim 1 or 2, wherein said means for discharging the radioactive waste further comprises means for inverting and turning up said containers, positioned respectively before and after said hopper in the rotational path of travel of said containers.

4. A system for treating radioactive waste, comprising:

a storage tank holding a slurry of the radioactive waste;

a condensing tank for condensing the slurry of radioactive waste received from said storage tank;

a dryer for drying the condensed radioactive waste;

a hopper for receiving the dried radioactive waste;

a rotary mechanism for transferring the radioactive waste from said condensing tank and to said dryer and hopper, said rotary mechanism comprising a plurality of containers for holding the radioactive waste, rotary arms for supporting said containers, a rotational drive mechanism for rotating said rotary arms, means for discharging the radioactive waste from said containers to said hopper, means for discharging the radioactive waste from said containers to said hopper, and a lift mechanism for vertically lifting said containers up and down; and a rotary collector positioned in a lower portion of said condensing tank for receiving the condensed radioactive waste and selectively transferring it to said containers up and down, said condensing tank further comprising a rotary collector, said condensing tank further comprising a rotary collector including a housing block having a vertical bore forming inlet and outlet openings on the upper and lower sides thereof in alignment with an opening at the bottom of said condensing tank and a tapered bore formed perpendicularly to and across said vertical bore, a rotary shaft having a tapered body portion fitted in said tapered bore and provided with a cavity in said tapered body portion in alignment with said inlet opening for collecting radioactive sediment, a spring urging one end of said rotary shaft in the tapered direction thereof, and a rotational drive mechanism connected to the other end of said rotary shaft for rotating said rotary shaft through a predetermined angle, the radioactive sediment collected in said cavity being passed through said outlet opening upon rotation of said rotary shaft.

5. A system as set forth in claim 4, wherein said lift mechanism lifts said rotary arms up and down.

6. A system as set forth in claim 4, said lift mechanism being positioned beneath said dryer and said condensing tank, respectively, whereby said container is lifted up and down when said container is disposed beneath said dryer or said condensing tank.

* * * * *

UNITED STATES PATENT AND TRADEMARK OFFICE

CERTIFICATE OF CORRECTION

PATENT NO. : 4,439,318

DATED : March 27, 1984

INVENTOR(S) : Masaru Hayashi, et al.

It is certified that error appears in the above-identified patent and that said Letters Patent is hereby corrected as shown below:

On the title page;

In the abstract, line 3, change "for" to --of--, and line 4, after "stage" change "of" to --for--;

In column 5, line 3, change "is" to --its--;

In column 5, line 40, change "postions" to --positions--, and line 52 change "descirbed" to --described--;

In column 6, line 2, after "impacting" delete "on";

Signed and Sealed this

*Sixteenth* Day of *July 1985*

[SEAL]

*Attest:*

DONALD J. QUIGG

*Attesting Officer* *Acting Commissioner of Patents and Trademarks*